US009453711B2

(12) United States Patent
Martin

(10) Patent No.: US 9,453,711 B2
(45) Date of Patent: Sep. 27, 2016

(54) WEAPONS FIRING RANGE SYSTEM AND APPARATUS EMPLOYING REFLECTED IMAGERY

(71) Applicant: Randy Wayne Martin, Lenoir, NC (US)

(72) Inventor: Randy Wayne Martin, Lenoir, NC (US)

( * ) Notice: Subject to any disclaimer, the term of this patent is extended or adjusted under 35 U.S.C. 154(b) by 627 days.

(21) Appl. No.: 13/987,077

(22) Filed: Jul. 2, 2013

(65) Prior Publication Data

US 2015/0017608 A1 Jan. 15, 2015

(51) Int. Cl.

| | |
|---|---|
| ***F41A 33/04*** | (2006.01) |
| ***F41J 1/01*** | (2006.01) |
| ***F41J 1/10*** | (2006.01) |
| ***F41J 9/02*** | (2006.01) |
| ***F41J 11/00*** | (2009.01) |
| ***F41J 11/02*** | (2009.01) |

(52) U.S. Cl.

CPC .. *F41J 1/01* (2013.01); *F41J 1/10* (2013.01); *F41J 9/02* (2013.01); *F41J 11/00* (2013.01); *F41J 11/02* (2013.01)

(58) Field of Classification Search

CPC ..... F41A 33/00; F41A 33/04
USPC ..... 434/16
See application file for complete search history.

(56) References Cited

U.S. PATENT DOCUMENTS

| | | | | |
|---|---|---|---|---|
| 4,934,937 | A | 6/1990 | Judd | |
| 5,194,006 | A | 3/1993 | Zaenglein et al. | |
| 5,551,876 | A | 9/1996 | Koresawa et al. | |
| 5,580,063 | A * | 12/1996 | Edwards | F41J 1/01 273/378 |
| 5,599,187 | A | 2/1997 | Mesiano | |
| 7,329,127 | B2 | 2/2008 | Kendir et al. | |
| 8,006,981 | B2 | 8/2011 | Gibson | |
| 8,126,838 | B2 | 2/2012 | Stone et al. | |
| 8,597,026 | B2 * | 12/2013 | Cincotti | F41H 3/00 434/22 |
| 2005/0262999 | A1 * | 12/2005 | Tomczyk | F41H 5/0457 89/36.02 |
| 2011/0300514 | A1 * | 12/2011 | Didier | E04H 1/12 434/11 |

* cited by examiner

*Primary Examiner* — Robert J Utama
*Assistant Examiner* — Elroy S Crocker

(57) ABSTRACT

A live fire weapons firing range includes a training area having a target wall, a rear wall and side walls extending between the target wall and the rear wall. An internal partition is oriented within the training area, so as to divide the training area into a shooter area, an actor area, and a fire engagement area. A reflective target is positioned on the target wall and is simultaneously viewable from both the shooter area and the actor area, such that an actor/instructor in the actor area is viewable to the shooter in the shooter area via a reflected image of the actor from the reflective target. The actor and the shooter engage in fire, shooting at the reflective target, which allows the live fire ammunition to pass through the reflective target, with the ammunition being captured by absorbing material positioned behind the reflective target.

9 Claims, 3 Drawing Sheets

WEAPONS FIRING RANGE SYSTEM AND APPARATUS EMPLOYING REFLECTED IMAGERY

CROSS-REFERENCE TO RELATED APPLICATIONS

This application claims priority to U.S. Provisional Patent Application 61/744,219, filed Sep. 21, 2012, entitled "Responsive Conditioning and Enhancement Training for Law Enforcement, Military and High-Risk Security Personnel Using Live Weapons Fire at Highly Reflective Target", to Randy Martin, et. al.

FIELD OF THE INVENTION

This invention relates to a system and apparatus for use in training soldiers, police and security personnel in the use of firearms under simulated confrontational conditions, especially live-fire training exercises.

BACKGROUND OF THE INVENTION

For training police officers, security personnel and soldiers in the use of firearms, it is desirable to incorporate methods and equipment to simulate conditions that the combatants will experience in an actual confrontation, and therefore make them better prepared to survive a deadly force encounter. Standing on a static line and shooting paper or steel targets will never replace the feeling and the threat encountered in a dynamic environment, where someone is returning fire. The actual confrontation, and therefore the training, should simultaneously involve both offensive and defensive action since the target is also firing and moving about.

Detractors of live-fire exercises stress the danger inherent in such evolutions, arguing that this type of training is unsafe; that the risk of injury or death outweighs the benefit of the training. Live-fire ammunition substitutes such as Simunitions, marking cartridges, or other less-lethal training ammunition have gained market share from live-fire exercises. Less-lethal training ammunition has its place in training and is effective. However, after having used these tools for a number of years, many officers/soldiers grow complacent or nonchalant with it and falsely believe that they won't truly get hurt or killed during this training unless it is accidental. Embarrassed perhaps, but not hurt or killed. Live fire adds an element of seriousness and stress that cannot be replicated.

What is needed therefore, is a method and apparatus that provides for the use of live-fire training scenarios, including the recoil, noise and heat, and the physical and mental aspects of firing real ammunition, but which also provides the highest levels of safety and injury reduction.

SUMMARY OF THE INVENTION

It is therefore an object of the present invention to provide a live-fire weapons firing range apparatus, including a training area having a target wall, a rear wall opposing the target wall, and side walls extending between the target wall and the rear wall. An internal partial partition is oriented within the training area, so as to divide the training area into a shooter area, an actor area, and a fire engagement area. A reflective target is positioned on the target wall and is simultaneously viewable from both the shooter area and the actor area, such that an actor/instructor in the actor area is viewable to the shooter in the shooter area via a reflected image of the actor/instructor from the reflective target. The actor and the shooter engage in fire, shooting at the reflective target, which allows the live-fire ammunition to pass through the reflective target, and absorbing material positioned behind the reflective target captures the ammunition.

It is another object of the present invention to provide a method of live-fire weapons training, including providing a training area having a target wall, a rear wall opposing the target wall, and side walls extending between the target wall and the rear wall. There is also provided an internal partial partition oriented within the training area, so as to divide the training area into a shooter area, an actor area, and a fire engagement area. A reflective target is positioned on the target wall and is simultaneously viewable from both the shooter area and the actor area, such that an actor/instructor in the actor area is viewable to the shooter in the shooter area via a reflected image of the actor/instructor from the reflective target. The method further enables the actor and the shooter to fire directly at the reflective target, reflecting the image of the actor or shooter, and allowing the live-fire ammunition to pass through the reflective target. Absorbing material positioned behind the reflective target captures the ammunition.

DETAILED DESCRIPTION OF THE INVENTION

Referring now in more detail to the drawings, a weapons firing range method and apparatus is described, which employs reflected imagery to enable live-fire scenarios, while still providing the highest levels of safety and injury reduction.

Figure 1:
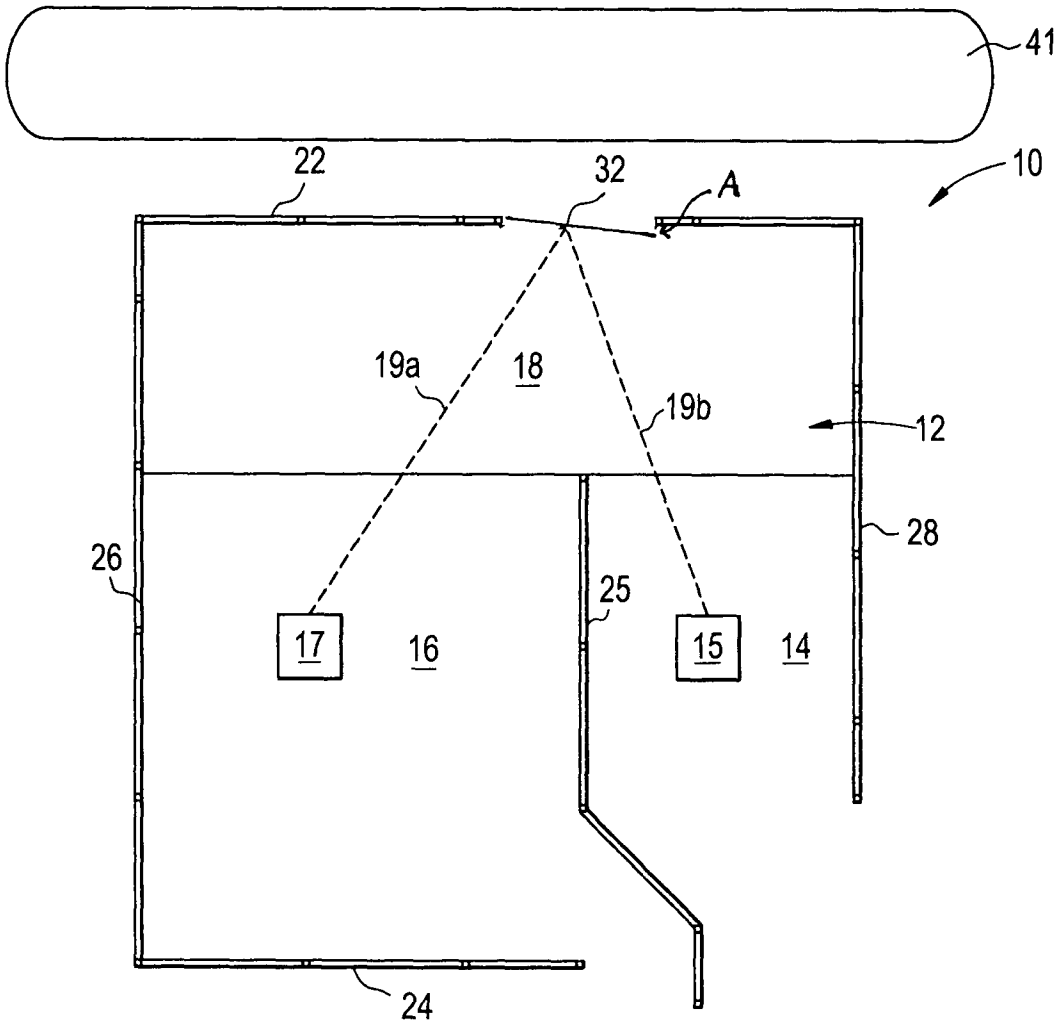
FIG. 1 is a top schematic view of the weapons firing range of the present invention.

Referring to FIG. 1, there is shown a weapons firing range of the present invention 10. The firing range 10 includes a training area 12 having a target wall 22, a rear wall 24 opposing the target wall, and side walls 26 and 28 extending between the target wall 22 and the rear wall 24. An internal partial partition wall 25 is oriented within the training area 12, so as to divide the training area 12 into a shooter area 14, an actor area 16, and a fire engagement area 18.

The internal partial partition 25 is oriented within the training area 12 to visually isolate actor(s) or actor-objects 17 in the actor area 16, from the shooter or shooter-objects 15 in the shooter area 14. This visual separation is critical to provide a necessary safety barrier to protect the shooter 15 from being distracted and cause him or her to make an unsafe movement or enable a dangerous situation to occur.

A reflective target 32 is positioned on the target wall 22. The reflective target 32 is positioned so that it is simultaneously viewable from both the shooter area 14 and the actor area 16. As shown by the reflected imagery dotted line 19*a*, 19*b* in FIG. 1, actor-objects 17 in the actor area 16 are viewable in the shooter area 14 via the reflected image 19*a*, 19*b* of the actor objects 17 from the reflective target 32.

Preferably, by way of example, the reflective target 32 comprises a reflective metalized Mylar film, with a mirror-like finish. One of ordinary skill in the art would understand that the use of other reflective films are within the scope of the present invention. The more mirror-like the finish, the better the training that will be realized. In addition to providing a mirror-like finish, the reflective target allows the firing range ammunition to pass there through, without significantly degrading the reflected image.

Preferably, the reflective target 32 projects at an angle (A) from the target wall 22 and toward the actor area 16. The reflective target 32 is angled slightly to ensure that the shooter 15 will not be able to see himself or herself in the reflective target 32 from any point within the shooter area 14.

To manufacture the reflective target 32, a single piece of a reflective metalized Mylar may be cut to the dimension of a frame such that the reflective film overlaps the back portion of the frame and is then affixed with tape, glue, staples or the like. Once affixed to the frame, one may apply heat with a heat gun to the front side of the reflective film to smooth out any imperfections or ripples in the reflective film. When completed the surface of the reflective film should be tight and have the clarity and reflective properties of a mirror.

Since the ammunition passes through the reflective target 32, for safety considerations, ammunition absorbing material 41 is placed outside the training area 12 and adjacent the rear wall 22 to sufficiently absorb ammunition fired in the training area 12, even live ammunition. A formed earth berm is an effective absorbing material, but one of ordinary skill in the art would understand that other absorbing materials, such as rubber or rubber tires, may be used within the scope of the present invention.

Figure 2:
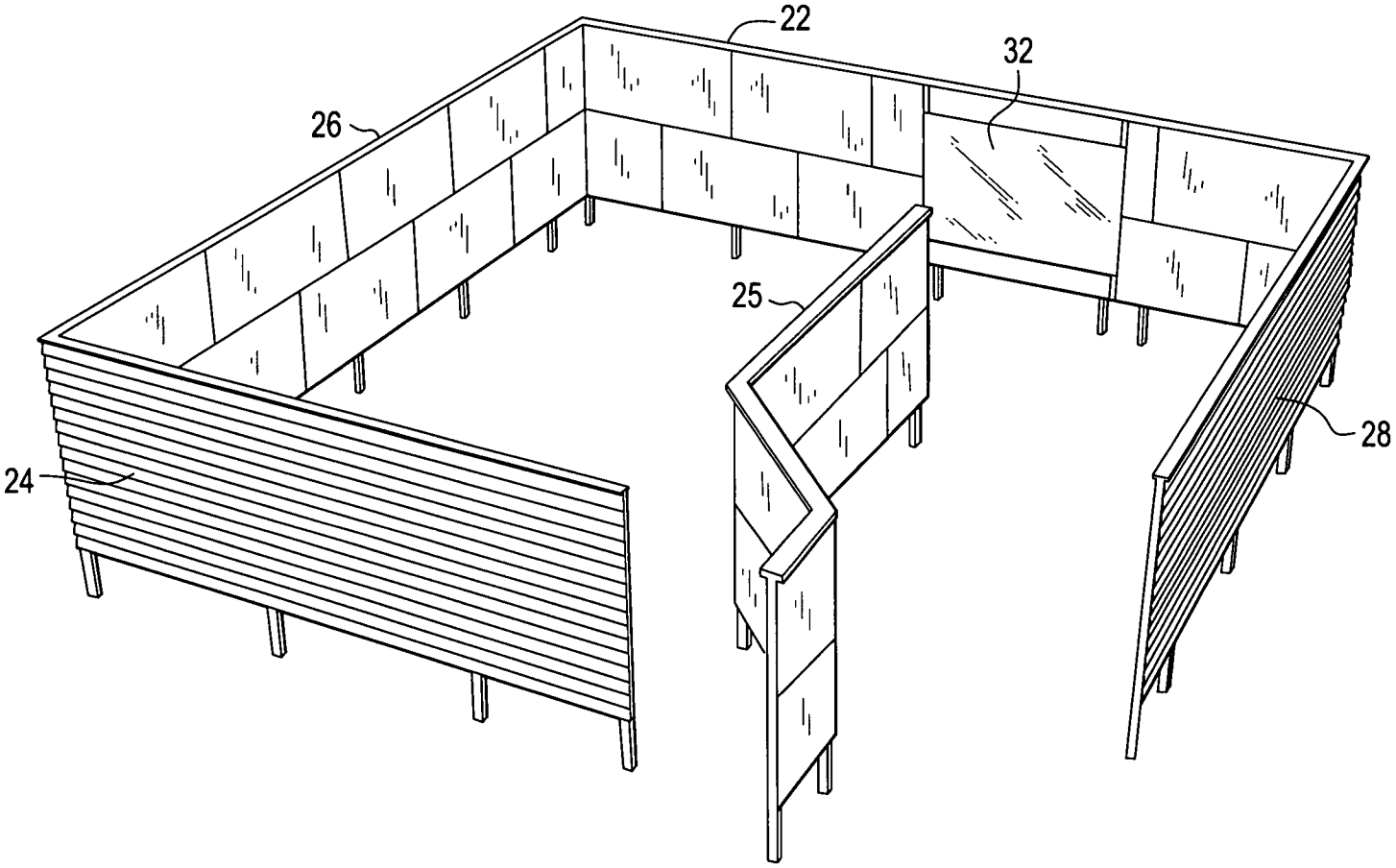
FIG. 2 is a perspective view of the weapons firing range of the present invention.

As shown more clearly in FIG. 2, the internal partial partition 25 is positioned perpendicular to the reflective target 32 and is spaced a distance therefrom. The internal partial partition 25 bisects an imagery line projected from near the center of the reflective target 32. In a preferred embodiment, the internal partial partition 25 is positioned approximately twelve feet from the reflective target 32 and approximately two feet to the left of the right edge of the reflective target 32, where the reflective target 32 is eight (8) feet in width.

Figure 3:
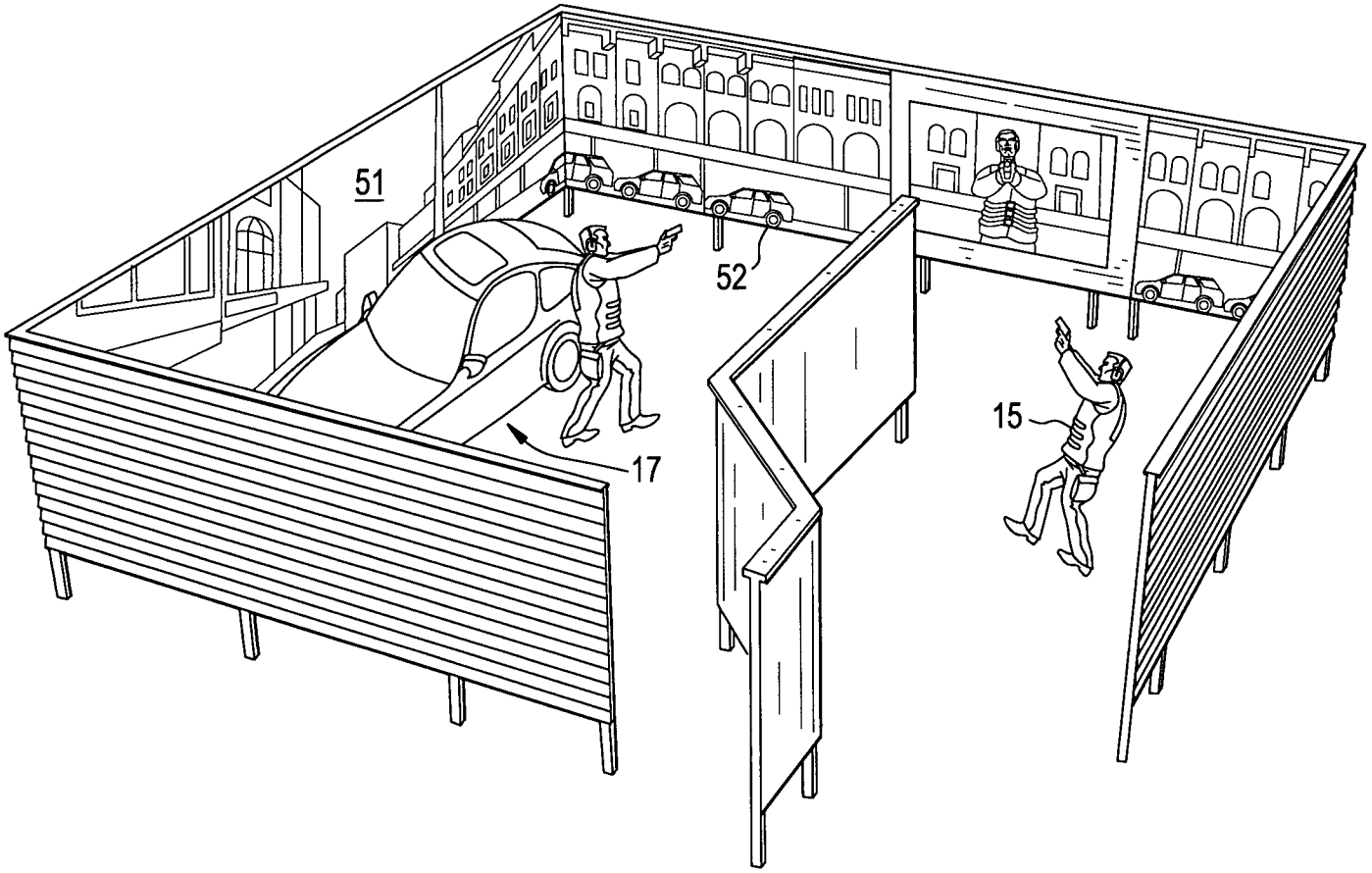
FIG. 3 is another perspective view of additional features of the weapons firing range of the present invention.

As shown in FIG. 3, additional realism can be achieved in a weapons training environment with the addition of backdrop images 51, 52 on the side walls 26, 28, target wall 22, or rear wall 24. The backdrop images 51, 52 are reflected in the reflective target 32, and are visible in the actor 16 and shooter areas 14.

To create or establish realistic scenarios for the shooter 15 and actor 17, the backdrops may be digitally reproduced graphics printed on vinyl banner material of a specific environment (i.e., downtown city block). A backdrop 51 is hung in the actor area 16 to create this visual effect. A similar backdrop 52 to that of backdrop 51 is hung in the shooter area 14 and along the target wall 22 to create this visual effect.

The significance of backdrop images 51, 52 are that the image of this backdrop will be viewed by the shooter 15 in the reflective target 32. In addition, the role-playing and acting out of the training scenario by the actor 17 will be performed in front of the backdrop 51, 52. This produces the desired visual effect that is needed to create the most realistic environment and situation for the shooter to assess and respond to during the training exercises.

This invention conditions the "shooter" 15 (FIG. 3) to assess a deadly encounter scenario or situation and to respond quickly and appropriately following polices and procedures on the use of deadly force. Real life scenarios acted out using real people during training exercises employing this invention will include both "shoot/no shoot" situations where law enforcement, military and high-risk security personnel must assess and respond to deadly and non-deadly encounters.

Other training methods that utilize stationary, moving, automated, electronic or computer-based procedures, are evaluated by scoring the shooter's performance. These training methods are taught by having the shooter engage using live fire at paper silhouette targets or other artificial targeting systems or through the use of highly technical computer-based environments (i.e., FATS or ISMS) where the shooter is essentially "playing a video game." These types of training methods are artificial and cannot simulate the same effect as shooting at a "live" human being, or in the case of the present invention, the "reflected image of the live person". No other training method is able to reproduce the realism of shooting at a "live" human being, or adequately conditions the mind of a shooter, so that the shooter will react or respond without hesitation or indecision in a deadly encounter event.

This invention utilizes live weapons fire where the shooter is shooting at a reflection of a deadly encounter event through actor role-playing, with such conviction that the shooter believes that he/she is responding to a real life situation and where the shooter momentarily believes that he/she is shooting at a "live" human being.

This invention does not focus on scoring the performance of the shooter. It is a training tool that provides the means for a shooter to self-assess their performance during the role-playing of any type of situation he/she may encounter in their line of duty. Through the use of role-playing, a specific situation can be "repeated" until the shooter gains the experience they require to achieve a successful outcome.

This invention is simple, cost effective and does not require any electronic equipment or electricity to operate. The reflective target 32 can withstand several hundred to a thousand or more rounds before it has to be replaced. It can be used either indoors or outdoors. It is not subject to changes in the environment. It can be used in any type of environment to include extreme heat, cold, rain or snow. Bullet holes in the reflective target 32 do not interfere or detract from subsequent shooter training sessions. Since the objective of this training is response and not score based, the target does not need to be replaced after each shooter.

The reflective target 32 along with the backdrops 51, 52 establish the training environment for the shooter 15, and the actor 17. The reflective target 32 is the focal point of the training exercise and provides the only means for the shooter 15, and the actor 17 to see each other. The reflective target 32 is the only component that is fired into by the shooter 15 and the actor 17 using live weapons. Of course, the same realism can be utilized with non-lethal ammunition if one desires.

As shown in FIG. 3, during the actual training exercise the actor 17 (or instructor) will act out role-playing within the actor area 16. Their actions and the image of the backdrop 51 or 52 will be viewed by the shooter 15 in the reflective target 32. Training scenarios will include both "shoot/no shoot" situations. The actor 17 may or may not possess or use a weapon. The shooter 15 and actor 17 have the opportunity and ability to interact verbally. As the training scenario and role playing unfolds as viewed by the shooter 15, and the actor 17 in the reflective target 32, the participants will decide whether they will engage in live fire using their weapons by shooting at the image of their opponent in the reflective target 32.

This invention is scalable. It can be modified for specific implementation in the field as needed. It can be implemented as a permanent environment (i.e., shoot house) on a firing range, or portable applications can be deployed as needed. Targets and backdrops can be configured for portable applications (i.e., sniper applications) or downsized for portability and convenience out in the field. Any environment or scenario can be easily achieved by changing backdrops and using effective props. For example, this invention can recreate a vehicle stop using vehicles by the actor and law enforcement (i.e., shooter) and backdrops to simulate a roadside or downtown setting.

Other parts or components could be introduced to enhance the shooter training experience to include sound effects, smells such as tear gas, and other effects such as explosive devices. Video cameras and other electronic devices could be deployed and strategically positioned to record and document each training session.

This invention combines the use of a highly reflective target along with a highly visual training environment and real life training scenarios that are acted out using real people as participants for the purpose of providing law enforcement, military and high-risk security personnel attending this training with an unsurpassed training experience that enhances their existing training and can take them to a higher level of training and awareness to keep them as safe as possible.

What is claimed is:

1. A Weapons Firing Range Apparatus, comprising:

a training area having a target wall, a rear wall opposing the target wall, and side walls extending between the target wall and the rear wall, and an internal partial partition oriented within the training area, so as to divide the training area into a shooter area, an actor area, and a fire engagement area;

a reflective target positioned on the target wall and simultaneously viewable from both the shooter area and the actor area, such that actor objects in the actor area are viewable in the shooter area via a reflected image of the actor objects from the reflective target, and wherein the reflective target allows firing range ammunition to pass there through.

2. The apparatus of claim 1, wherein the reflective target projects at an angle from the target wall and toward the actor area.

3. The apparatus of claim 1, wherein the reflective material is comprised of metalized mylar film.

4. The apparatus of claim 1, wherein the ammunition is live-fire ammunition.

5. The apparatus of claim 1, wherein said internal partial partition is perpendicular to said reflective target and spaced therefrom, and bisects an imagery line projected from near the center of the reflective target.

6. A method of live fire weapons training, comprising:

providing a training area having a target wall, a rear wall opposing the target wall, and side walls extending between the target wall and the rear wall, and an internal partial partition oriented within the training area, so as to divide the training area into a shooter area, an actor area, and a fire engagement area;

providing a reflective target positioned on the target wall and simultaneously viewable from both the shooter area or the actor area, and providing a reflective target allowing firing range ammunition to pass there through.

7. The method of claim 6, further comprising providing the reflective target at an angle projecting from the target wall and toward the actor area.

8. The method of claim 6, further comprising providing a metalized mylar film for the reflective material.

9. The method of claim 6, further comprising providing live-fire ammunition.

* * * * *